United States Patent [19]

Lusti

[11] 4,083,432

[45] Apr. 11, 1978

[54] SAFETY ARRANGEMENT

[75] Inventor: John Lusti, River Vale, N.J.

[73] Assignee: Otis Elevator Company, New York, N.Y.

[21] Appl. No.: 746,566

[22] Filed: Dec. 1, 1976

[51] Int. Cl.[2] ..... B66B 5/16

[52] U.S. Cl. ..... 187/89

[58] Field of Search ..... 187/73, 80, 89, 90, 187/91

[56] References Cited

U.S. PATENT DOCUMENTS

| | | | |
|---|---|---|---|
| 557,117 | 3/1896 | Ellithorpe | 187/91 |
| 1,937,035 | 11/1933 | Dunlop | 187/89 |
| 2,274,000 | 2/1942 | Sahlin | 187/90 |
| 2,298,167 | 10/1942 | Rissler | 187/90 |
| 2,402,285 | 6/1946 | Hymans | 187/89 X |
| 2,490,653 | 12/1949 | Sahlin | 187/90 |
| 3,441,107 | 4/1969 | Thorne et al. | 187/90 |

*Primary Examiner*—Evon C. Blunk
*Assistant Examiner*—James L. Rowland
*Attorney, Agent, or Firm*—Robert T. Mayer

[57] ABSTRACT

A safety arrangement for an elevator system includes a governor means driven by a vertically suspended elongated flexible member. The flexible member is attached to the actuating member of a braking means which is mounted on an elevator car. When the car overspeeds in a downward direction the governor, operating through the flexible member, actuates the braking means to stop the car. When the car is moving upwardly and decelerating, the flexible member produces an inertial force which is applied to the actuating member of the braking means. To prevent this inertial force from operating the braking means, the safety arrangement includes a compensating means. The compensating means is mounted on the car and operates in response to its deceleration at a predetermined rate to apply a compensating force to the actuating member. This compensating force has a predetermined magnitude and opposes the inertial force of the flexible member to prevent such inertial force from operating the braking means.

6 Claims, 5 Drawing Figures

SAFETY ARRANGEMENT

This invention relates to safety arrangements for an elevator system. More particularly it concerns apparatus for reliably operating braking safeties on an elevator car.

It is known in the elevator art to provide a safety arrangement which operates a braking safety to slow an elevator car when it exceeds a predetermined velocity in a downward direction. These known arrangements include a governor which is driven by a governor cable coupled to the elevator car. Upon exceeding a predetermined downward velocity a gripping jaw mechanism is caused to clamp upon and restrain movement of the governor cable. By restraining the governor cable in this manner an acutating force is transmitted to a tripping mechanism mounted on the elevator car. This force operates the trippping mechanism which causes the actuation of the braking safeties on the elevator car. These safeties grip the elevetor guide rails sufficiently to bring the car to a safe stop.

In the above arrangement the operation of the braking safety is influenced by the mass of the governor cable. The taller the building, the longer and thus the more massive is the required governor cable.

When the elevator is travelling upwardly and at a constant speed and starts to decelerate the governor cable because of its inertia tends to continue travelling upwardly at the constant speed. This produces an upward inertial force on the tripping mechanism associated with the braking safeties of the elevator car. The direction in which this force is applied is the same as the direction in which the actuating force is applied to operate the braking safeties. If a car decelerates at a sufficiently high rate, a sufficiently massive governor cable can cause the braking safeties to be actuated even though the governor is not operating to produce a restraining force on the governor cable. Accordingly, the elevator car can be inappropriately braked requiring service personnel to be summoned to restore operation.

Relatively large decelerations tending inappropriately to operate braking safeties, can occur if a car is stopped by means of its normal machine brake. As for example, when an electrical safety circuit within the elevator system causes the application of this machine brake. Under these circumstances the elevator car could decelerate at as much as one-third the rate of acceleration of gravity. Also the car can decelerate at the rate of acceleration of gravity if, for example, an elevator counterweight bottoms in a pit and causes loss of traction between the elevator drive sheave and its hoisting ropes. The greater the deceleration of the car, the greater is the tendency of the governor cable to inappropriately operate the braking safeties. If the car decelerates at the rate of acceleration of gravity, the governor cable can operate the braking safeties by applying to its tripping mechanism, a force approximately equalling the weight of the governor cable.

In the past application of braking safeties by such inertial forces of the governor cable was avoided by using a tripping mechanism which required application of a force exceeding a predetermined threshold magnitude before allowing operation of the braking safeties. The designer would calculate the maximum expected inertial force produced by a governor cable and design a spring detent mechanism which would not allow actuation of the associated braking safeties until a force exceeding this maximum was achieved.

Of course, the governor gripping jaw mechanism is designed to apply a restraining force to the governor cable in excess of this threshold magnitude. Consequently, the required tensile strength of the governor cable must exceed the threshold magnitude of the tripping mechanism. Since in conventional designs this threshold magnitude must be greater than inertial forces associated with deceleration of the governor cable, large inertial forces require a large threshold magnitude and a still larger tensile strength in the governor cable. This not only can increase the cost of the cable but also can increase its size and weight thereby compounding the problems caused by inertial forces it produces.

In modern high rise buildings a governor cable can be so long and heavy that the inertial forces that are produced when the car decelerates can be unusually large. If, as in conventional arrangements, a governor's gripping jaw mechanism produces a restraining force significantly in excess of the inertial force produced by the governor cable, there is a danger of gripping the cable too tightly and damaging it. Furthermore, as mentioned, increases in the restraining force require an increase of the tensile strength of the governor cable. Attempts to increase the tensile strength by using a cable with a larger diameter may only further increase the mass of the cable and exacerbate the situation.

Moreover a governor which would be capable of applying such large restraining force could require relatively large gripping jaws so that the restraining force is distributed over a relatively long section of the governor cable. Also the governor may require a jaw actuating mechanism which is specifically designed for such relatively large restraining force. The foregoing can increase the size and cost of the governor.

It is an object of this invention to provide an improved safety arrangement for an elevator.

It is a further object of this invention to provide a braking means which compensates for inertial forces produced by a governor cable when its associated elevator car is upwardly decelerating.

A feature of the present invention is the provision of a compensating means which produces in response to upward deceleration of an elevator car a compensating force which opposes inertial forces produced by the governor cable. In the constructed embodiment a spring loaded weight is mounted on the car to produce this compensating force. This spring loaded weight operates upon a plunger which engages a notch on a sliding bar. To apply the braking safeties the governor cable must produce a force which pulls the sliding bar out of engagement with the plunger. The weight used in the constructed embodiment is so arranged that it operates to increase the force the plunger applies to the notch of the sliding bar when the car is moving upwardly and decelerating.

In an alternate embodiment of the present invention a pivotally mounted releasing member is attached to the spring loaded weight. As before, upon deceleration of the elevator car when it is moving upwardly, the weight produces a force tending to restrain the actuating member and increase the force required to actuate the braking safeties.

According to the present invention a safety arrangement is provided for use in an elevator system in which an elevator car guided by guide rails can be upwardly moved and stopped at a predetermined rate of deceleration by a hoisting machine. The safety arangement includes a braking means having an actuating member. This braking means is mounted on the car for applying a braking force to the guide rails to stop the car in response to a force exceeding a predetermined threshold magnitude being applied to the actuating member. Also included is a vertically suspended elongated flexible member which is attached to the actuating member and is movable therewith. This flexible member has a given mass so that in response to the car being decelerated at the predetermined rate during upward movement, the flexible member applies an inertial force to the actuating member in excess of the predetermined threshold magnitude. The safety arrangement also includes a governor means which is driven by the flexible member for applying through the flexible member an actuating force of the predetermined threshold magnitude to the actuating member in response to the car exceeding a predetermined downward velocity. Also included is a compensating means which is mounted on the car and operates in response to deceleration of the car at the predetermined rate during upward movement to apply to the actuating member a compensating force having a predetermined magnitude opposing the inertial force and preventing the inertial force from operating the braking means.

Other objects and features of the invention will be apparent from the foregoing and the following description when considered in conjunction with the appended claims and the accompanying drawing in which:

Figure 1:
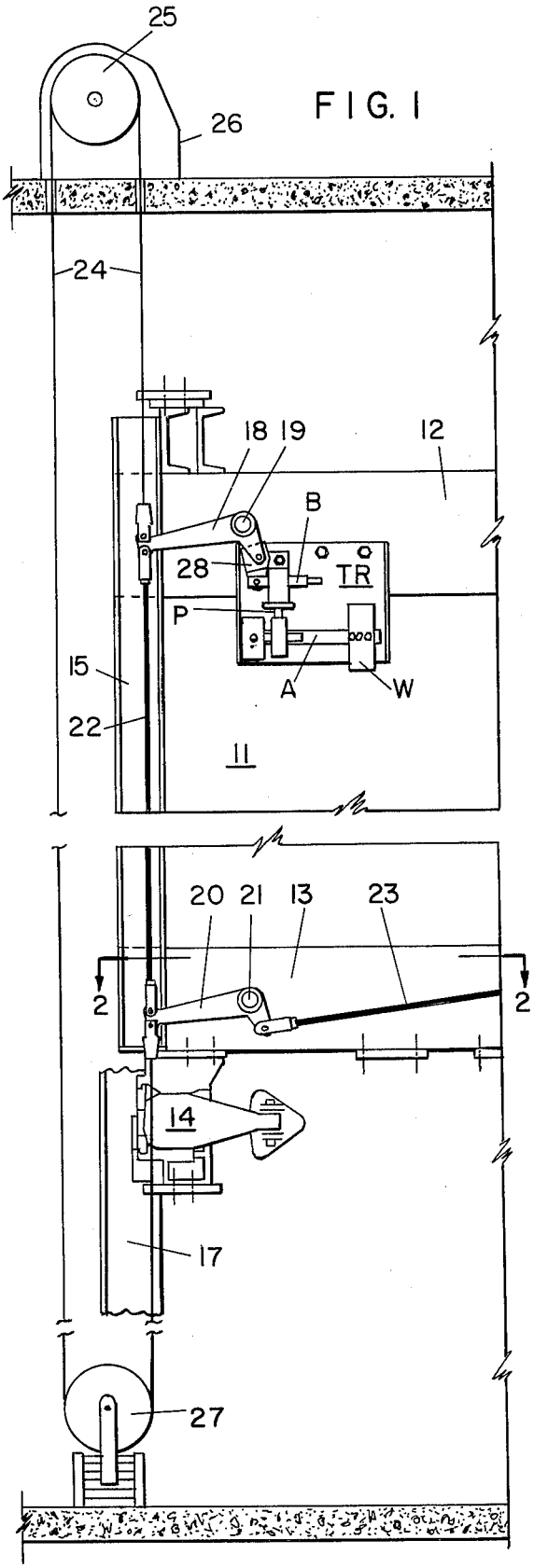
FIG. 1 is an elevation view of portions of an elevator system according to the constructed embodiment of the invention.

Referring first to FIG. 1, a portion of an elevator car 11 is shown in elevation. Major structural members of car 11 include crosshead 12, floor beam 13 and upright support 15. Mounted underneath, on one end of floor beam 13 is braking safety 14, it being understood that a complementary braking safety (not shown) is mounted on the other, unillustrated end of floor beam 13. Also in the constructed embodiment of the present invention two additional braking safeties were mounted on opposing ends of crosshead 12, in vertical alignment with the braking safeties on floor beam 13. These additional safeties are not illustrated for simplification purposes.

Braking safety 14, as is well known, upon actuation grips rail 17 to stop the car. Rail 17 is broken for purposes of illustration but actually extends throughout the path of travel of car 11 in the hoistway. Also there is a complementary rail (not shown) which cooperates with the unillustrated safety on the unillustrated end of beam 13.

Governor lever 18 is mounted on shaft 19 which is journaled in crosshead 12. Governor lever 20 is mounted on shaft 21 which is journaled in beam 13. Governor levers 18 and 20 are linked together by linkage 22 so that they move together. Also, governor lever 20 has connected to it linkage 23 which when moved can cause a safety (not shown) mounted on the unillustrated end of beam 13 to operate in a well known manner.

Levers 18 and 20 are connected to a vertically suspended elongated flexible member comprising governor cable 24 which extends upward from lever 18 into the machine room and around sheave 25 of governor means 26, then down to the pit and around tensioning sheave 27 and back to lever 20. In normal operation, levers 18 and 20 are held in the positions shown by tripping mechanism TR, comprising weight W, lever arm A, plunger P, plate 28 and sliding bar B all of which are more clearly illustrated in FIG. 3. In the constructed embodiment tripping mechanism TR is provided with a cover which is not shown in FIG. 3 for clarity of illustration.

Braking safety 14, levers 18 and 20, shafts 19 and 21, links 22 and 23, plate 28 and bar B comprise that part of the invention referred to as a braking means. Lever 18, plate 28 and bar B comprise that part of the braking means referred to as an actuating member.

Governor 26 may be any of several kinds which can suitably grip cable 24 as car 11 reaches a predetermined speed in a downward direction. Governor 26 is that part of the invention referred to as a governor means. Operation of a known governor is described in U.S. Pat. No. 3,441,107. Such governors include rope gripping jaws mounted on opposite sides of cable 24. These jaws engage cable 24 to produce a force tending to restrain it. When this happens, cable 24 and the left arm of levers 18 and 20 decelerate. This slower descent is more conveniently thought of as a raising of the left arms of levers 18 and 20.

Figure 2:
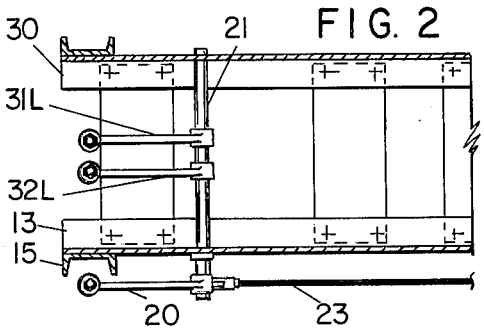
FIG. 2 is a sectional view along lines 2—2 of FIG. 1.

Referring now to FIG. 2, sectional view 2–2 of FIG. 1 is illustrated. In this view, certain elements such as braking safety 14 and guide rail 17 have not been illustrated for purposes of simplification. Previously illustrated lever 20 is shown mounted on shaft 21 which is journaled in floor beams 13 and 30. Also mounted on shaft 21 are a pair of lift levers 31 L and 32 L. The free ends of levers 31 L and 32 L are connected to a braking safety 14 which is mounted immediately below these free ends, by means of lift rods (not shown). Rotation of levers 31 L and 32 L in a direction to raise their free ends will raise the lift rods to cause safety 14 to operate.

Figure 3:
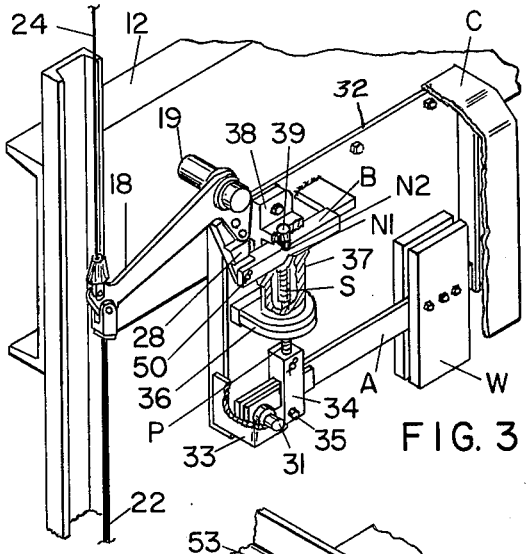
FIG. 3 is a detailed view of a portion of FIG. 1.

Referring now to FIG. 3, previously mentioned tripping mechanism TR and associated components are illustrated in detail. Weight W is bolted to lever arm A which is pivotally supported by pin 31. Pin 31 is disposed between plate 32 and bracket 33 (broken for purposes of illustration). Bracket 33 is suitably attached to plate 32 which is bolted to crosshead 12. Slotted bar 34 surrounds arm A on three sides with the fourth side being enclosed by means of pin 35. Threaded into the top of bar 34 is plunger P which extends upwardly through lower flange 36 of housing 37 to engage downwardly disposed notch N1 in bar B (more clearly illustrated in FIG. 4). Housing 37 is mounted on plate 32 by suitably fastening upper tab 38 and lower flange 36 to that plate. The upper portion of plunger P and all of spring S (see FIG. 4 for a clearer illustration) are enclosed in housing 37. Suitably fastened to housing 37 above bar B is tapered pin 39 which engages notch N2 of bar B. Connected to the slotted end of bar B by means of pin 50 is plate 28 which is suitably fastened to lever arm 18.

Cover C (broken for illustrative purposes) is suitably fastened to plate 32 to protect the tripping machanism.

Weight W, arm A, pins 31 and 35, slotted bar 34 and plunger P are that part of the invention referred to as the compensating means. Spring S is that part of the constructed embodiment of the invention referred to as the resilient means.

Figure 4:
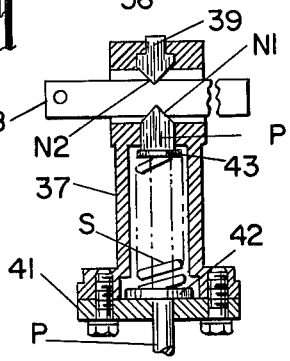
FIG. 4 is a sectional view of a portion of the apparatus of FIG. 3.

FIG. 4 is a detailed sectional view of housing 37, plunger P, bar B and pin 39 which were previously described. Housing 37 includes a bottom plate 41 which is bolted thereto and which provides support for washer 42 and the lower end of spring S. Spring S bears against washer 43 which bears against a shoulder in plunger P.

Figure 5:
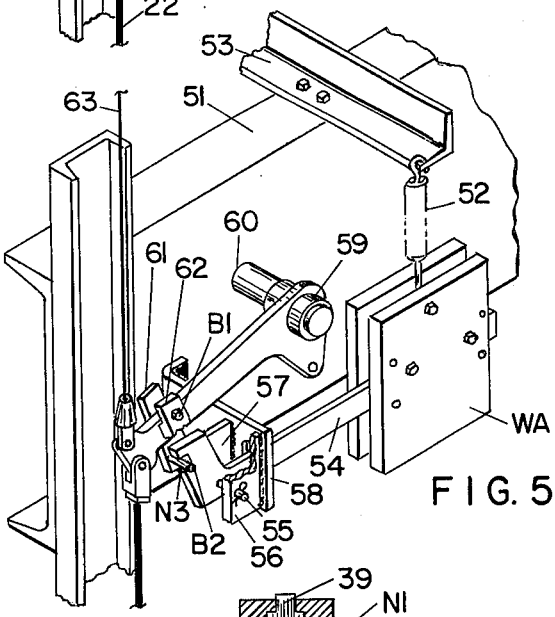
FIG. 5 is a detailed view of a part of an alternative embodiment of the present invention.

Referring now to FIG. 5 an alternate form of tripping mechanism is shown mounted on car structural member 51.

Member 51 is that part of an elevator structure corresponding to crosshead 12 of FIG. 1. Tension spring 52 is suspended between weight WA and angle iron 53 which is bolted to member 51. Weight WA is attached to lever arm 54 which is pivotally supported by pin 55. Pin 55 is mounted in apertures in mounting tabs 56 and 57 which are both suitably attached to mounting plate 58. Mounting plate 58 is suitably attached to member 51. Lever 59 and shaft 60 correspond to and operate identically as lever 18 and shaft 19 respectively, of FIG. 1. Lever 59 is connected to governor cable 63 which corresponds to cable 24 of FIG. 1. Accordingly, lifting of lever 59 so that shaft 60 rotates clockwise causes the car braking safeties to operate. Symmetrically located on either side of lever 59 are two complementary brackets 61 and 62 which are clamped to lever 59 by means of bolts B1 and B2. It is noted that bracket 62 and bolt B2 are broken for purposes of illustration. The four elements, brackets 61 and 62 and bolts B1 and B2, encircle and clamp to lever 59 in such a way that the shaft of bolt B2 is horizontally spaced below lever 59.

Notch N3 is formed in one end of arm 54. Notch N3 is located and dimensioned so that if arm 54 and lever 59 are positioned as shown in FIG. 5, notch N3 engages the shaft of bolt B2. Since arm 54 is pivoted on pin 55, arm 54 can rotate clockwise with respect to pin 55 so that notch N3 disengages bolt B2.

Arm 54 is that part of the invention referred to as a releasing member and lever 59, brackets 61, 62, and bolts B1, B2 are that part of the invention referred to as the actuating member. Tension spring 52 is that part of the alternate embodiment of the invention referred to as a resilient member attached to the car for urging weight WA upwardly.

To facilitate an understanding of the invention, its operation will be first described for the situation wherein the car 11 of FIG. 1 is travelling downwardly and then exceeds a predetermined velocity so that the braking safety 14 is actuated. Subsequently, operation will be described for a situation wherein the car is moving upwardly but decelerating at a predetermined rate so that inertial forces produced by governor cable 24 are in a direction tending to operate braking safety 14.

Assume now that car 11 is moving downwardly at a speed just slightly less than a predetermined velocity and also that it is accelerating at a relatively small rate so that weight W does not produce significant inertial forces associated with such acceleration. As car 11 gradually accelerates it eventually exceeds the above mentioned predetermined velocity. Under these circumstances governor 26 grips cable 24 and applies a force which tends to restrain its downward movement. Accordingly, this force is applied to lever 18 at its connection point with governor cable 24. Application of this force to lever 18 tends to cause it and shaft 19 to rotate clockwise (FIG. 1). This is resisted however, by tripping mechanism TR.

Plunger P applies an upward threshold force against notch N1 of bar B (FIG. 4) which tends to restrain movement of bar B. The upward threshold force on plunger P depends upon the force produced by spring S minus the static force produced by weight W (FIG. 3). The force produced by spring S can be readily calculated by using the well known spring constant. The static force produced by weight W as applied to plunger P can be calculated using simple mechanical formulae. This latter calculation requires that the weight of weight W be multiplied by a factor corresponding to the ratio of the effective length of the moment arm from pin 31 to weight W and the effective length of the moment arm from pin 31 to plunger P (FIG. 3). It is understood that the details of such calculations are within the grasp of persons skilled in the mechanical arts. It is further understood that persons skilled in the mechanical arts, knowing the upward force applied by plunger P can readily calculate the force which must be applied to lever 18 in order to pull bar B out of engagement with plunger P. If sufficient force is applied to bar B, the inclined surface of notch N1 forces plunger P to move downwardly and compress spring S (FIG. 3). If plunger P moves down a sufficient amount bar B is no longer entrapped and the tripping mechanism TR (FIG. 1) is deemed "tripped".

Since governor 26, in gripping cable 24, applies a force sufficient to overcome the threshold force applied by plunger P and to pull bar B out of engagement with plunger P, lever 18 rotates. Since lever 18 is connected to lever 20 by means of link 22 both of these levers rotate simultaneously. Rotation of lever 20 also causes levers 31 L and 32 L on common shaft 21 (FIG. 2) to rotate. Rotation of levers 31 L and 32 L cause safety 14 (FIG. 1) to operate in a conventional manner. As is well known, in operating, braking safety 14 applies a restraining force upon guide rail 17 to decelerate car 11. It is also noted that rotation of lever 20 moves linkage 23 to cause operation of a safety on the unillustrated end of beam 13, in a conventional manner.

The foregoing described the actuation of braking safety 14 under circumstances wherein car 11 overspeeds in the downward direction. The following describes an operation wherein the car is at first moving upwardly at a constant velocity and then suddenly experiences relatively large deceleration.

As previously described, the threshold force applied by plunger P to bar B depends on the force produced by spring S minus the static force produced by weight W. Under such conditions the forces on plunger P are of a magnitude sufficient to prevent vibrations in cable 24 or similar disturbances form actuating braking safety 14 inappropriately.

The static force of weight W reduces the force spring S would otherwise apply through plunger P to bar B. This static force is an independent constant. If weight W decelerates, an independent inertial force is produced. This inertial force will be discussed without referring to the constant static force for the remainder of this description.

Assume now that elevator car 11 in moving upwardly at a constant velocity, suddenly commences decelerating. Governor cable 24 and weight W, which were also previously traveling upwardly at a constant velocity, have a tendency to continue traveling upwardly at this same constant velocity. Referring to FIG. 3, governor cable 24 will tend to continue traveling upwardly at a constant velocity whereas shaft 19, which is part of the car structure, must decelerate with the car. As a consequence, cable 24 produces an inertial force which pulls upwardly on lever 18 to produce a moment tending to turn shaft 19 clockwise. If the rate of deceleration was high enough and this force exceeded the threshold force applied by plunger P and was not compensated for it would cause braking safety 14 to operate.

However, during this upward deceleration, weight W has a tendency to continue travelling upwardly at constant velocity whereas pin 31, which is connected through bracket 33 and plate 32 to the car structure, must decelerate with the car. Therefore the inertial force produced by weight W tends to pull arm A upwardly. This inertial force changes the moment produced by weight W on arm A in a direction to increase the force applied to plunger P. As will become apparent, if inertial force produced by weight W is high enough to counteract that produced by governor cable 24 braking safety 14 (FIG. 1) is not operated.

As stated previously, the inertial force produced by govenor cable 24 pulls upwardly on lever 18 so that it and bar B have a tendency to move. On the other hand, the inertial force produced by weight W tends to pull arm A upwardly. As a result plunger P bears into notch N1 of bar B with increased force. This tends to restrain bar B and lever 18. By using a weight having sufficient mass and an arm of sufficient length, the inertial forces produced by weight W and applied to plunger P will increase during upward deceleration by an amount sufficient to prevent the inertial forces produced by governor cable 24 from moving lever 18 and withdrawing bar B from engagement with plunger P. If bar B and lever 18 are prevented in this manner from moving, safety 14 is not operated in this inappropriate manner. Accordingly, weight W produces a compensating force which is applied to bar B and lever 18, as a function of the deceleration of car 11.

As noted previously, by designing weight W to be sufficiently large (or arm A to be sufficiently long) the force required to operate braking safety 14 can be increased by an amount equalling the inertial forces produced by governor cable 24 under conditions of upward deceleration. Alternatively, the mass of weight W or the length of arm A can be designed to produce compensating forces smaller than that just described. In the latter case inertial forces produced by governor cable 24 are partially compensated. Spring S, however, can be designed to produce sufficiently large threshold forces so that the partially compensated inertial forces of governor cable 24 do not actuate braking safety 14.

In FIG. 5 an alternate embodiment of the present invention is illustrated. Instead of using a sliding bar as in the embodiment of FIG. 3, the apparatus of FIG. 5 operates with two pivotally mounted members, lever 59 and arm 54. In this alternate embodiment weight WA cooperates with tension spring 52. Accordingly, a net upward threshold force is applied to the weighted end of arm 54 which is equal to the force produced by tension spring 52 less the static force produced by weight WA.

Assume that the car structural member 51 is traveling downwardly at a velocity just slightly less than a predetermined velocity and that it is accelerating slightly. The predetermined velocity is the velocity above which an associated governor (not shown) will clamp upon governor cable 63 to restrain its movement.

Before the governor restrains governer cable 63, arm 54 and lever 59 are positioned as shown in FIG. 5. Spring 52 applies force to weight WA sufficient to lift it so that a net upward threshold force is applied to the weighted end of arm 54 which tends to rotate it counterclockwise with respect to pin 55. This drives notch N3 of arm 54 into engagement with the shaft of bolt B2. Since it was assumed that the car and thus weight WA are accelerating only slightly, inertial forces associated with weight WA are considered insignificant.

When the car exceeds the predetermined velocity so that the governor restrains governor cable 63, it tends to decelerate. Since the car and its structural member 51 are still moving at a relatively constant downward velocity, cable 63 applies an upward force at its connection point with lever 59. This upward force is in a direction tending to rotate lever 59 and shaft 60 clockwise. This upward force also produces through brackets 61 and 62 an upward force on bolt B2. The upward force so applied to bolt B2 communicates an upward force to notch N3 to produce a clockwise moment on arm 54 with respect to pin 55. This moment is sufficient to stretch spring 52 and rotate arm 54 clockwise with respect to pin 55. Such rotation moves notch N3 out of engagement with bolt B2. Upon such disengagement, the upward force applied to the end of lever 59 rotates shaft 60 and operates the braking safeties in a manner identical to that previously described in connection with FIG. 1.

To facilitate an understanding of how inertial forces in the governor cable are compensated, operation will now be described under different conditions. Assume the car and its structural member 51 is at first traveling upwardly at a constant velocity and then suddenly decelerates at a relatively large rate. The operation of the equipment illustrated in FIG. 5 will be described under these assumed conditions.

When the car structural member 51 is traveling at constant velocity, it is equivalent to the system operating under static conditions. Governor cable 63 and weight WA produce static forces but no inertial forces. Accordingly, weight WA produces a downward force which is countered by the upward force produced of spring 52. The net result is that arm 54 is pulled upwardly at its weighted end. This produces a moment which causes notch N3 on the unweighted end of arm 54 to bear against and engage the shaft of bolt B2. As long as the shaft of bolt B2 is entrapped in notch N3, lever 59 and shaft 60 are not free to rotate and operate the braking safeties.

Assume now that the car and its structural member 51 commences decelerating upwardly at a rapid rate. Weight WA and governor cable 63, formerly travelng upwardly at constant velocity, will tend to continue traveling at such constant velocity. Therefore, since pin 55, being attached to the car member 51 by means of brackets 56, 57, and plate 58, decelerates with the car weight WA will tend to move upwardly with respect to pin 55. Accordingly, weight WA will produce an inertial force on the weighted end of arm 54 tending to move it upwardly and to rotate it counterclockwise about pin 55. Similarly, governor cable 63 will tend to continue traveling upwardly at a constant velocity with respect to shaft 60, which is journaled in car structural member 51. Accordingly, governor cable 63 produces an upward force at its connection point with lever 59 thereby tending to rotate shaft 60 clockwise.

In order for lever 59 to rotate, arm 54 must rotate clockwise on pin 55 so that notch N3 disengages the shaft of bolt B2. Since lever 59 is being urged upwardly by cable 63, so is bolt B2. The upward force on bolt B2 communicates a force to notch N3 which is in a direction tending to cause arm 54 to rotate clockwise around pin 55. If the rate of deceleration was high enough and this inertial force was not compensated it would cause the braking safeties to be applied. However, the previously described inertial forces associated with weight WA prevent this.

In summary then, the inertial forces produced by governor cable 63 tend to rotate arm 54 clockwise (as shown in FIG. 5) while inertial forces produced by weight WA tend to rotate arm 54 counterclockwise. It is clear, therefore, that the inertial forces produced by governor cable 63 and weight WA tend to balance one another.

By making weight WA sufficiently massive or arm 54 sufficiently long, all of the inertial forces produced by governor cable 63 can be compensated. Alternatively, a less massive weight (or shorter arm) can be used in which case the inertial forces of governor cable 63 are only partially compensated. In this case, tension spring 52 can be designed to provide upward threshold forces sufficient to drive notch N3 into engagement with the shaft of bolt B2 so that the inertia forces generated by governor cable 63 do not cause shaft 60 to rotate and operate the braking safeties.

Various modifications to the foregoing arrangements will be evident to those skilled in the art including providing a similar arrangement for an elevator counterweight. For these reasons it is intended that the arrangements will be considered illustrative only and not limiting in any sense.

What is claimed is:

1. In an elevator system in which an elevator car guided by guide rails can be stopped by a hoisting machine when said car reaches a predetermined rate of deceleration, a safety arrangement comprising:

braking means having an actuating member mounted on said car;

a vertically suspended elongated flexible member attached to said actuating member and movable therewith;

governor means driven by said flexible member applying to said actuating member through said flexible member an actuating force of a predetermined magnitude in response to said car exceeding a predetermined velocity, said actuating member responding to said actuating force and causing a braking force to be applied to said guide rails to initiate stopping of said car; said flexible member having a mass such that in response to said car being decelerated at said predetermined rate during upward movement said flexible member applies an inertial force to said actuating member having a magnitude in excess of said predetermined magnitude of said actuating force; and compensating means including a lever arm pivotally mounted on said car and a weight carried by said lever arm, said lever arm being coupled to said actuating member and operating in response to deceleration of said car at said predetermined rate during upward movement to apply to said actuating member a compensating force produced by said weight opposing said inertial force and preventing said inertial force from operating said braking means.

2. In an elevator system according to claim 1, a resilient member operably connected with said compensating means for applying to said actuating member a threshold force sufficient to prevent forces less than said actuating force from actuating said braking means.

3. In an elevator system according to claim 2, wherein said actuating member is pivotally mounted on said car, and wherein said lever arm is elongated and has a notched end engaging said actuating member to resist pivotal movement of said member, said weight being attached to said lever arm at the end opposite said notch;

a pin mounted on said car and pivotally supporting said lever arm at a position between said notched end and said weight;

said resilient member including a spring attached to said car and to said weight and urging said weight upwardly, said weight applying to said actuating member through said lever arm said compensating force as a result of the inertial force produced by said weight in response to upward deceleration of said car, and said spring applying said threshold force to said actuating member through said lever arm.

4. In an elevator system according to claim 2, wherein said resilient member includes:

a spring mounted on said car for urging said weight upwardly.

5. In an elevator system according to claim 2, wherein said actuating member comprises a bar slidably mounted on said car, said bar being movable in response to application of said actuating force, sliding movement of said bar operating to cause said braking means to apply said braking force to said guide rails and wherein said resilient member includes:

a plunger for engaging said bar and resisting sliding movement thereof; and a spring mounted on said car and urging said plunger into engagement with said bar, said weight being mechanically coupled to said plunger to apply thereto inertial forces produced by said weight.

6. In an elevator system according to claim 5, wherein said bar has a downwardly disposed notch and is mounted to be slidably movable in a horizontal direction, said spring urging upwardly said plunger to engage its upper end in said notch.

* * * * *